US007848929B2

(12) United States Patent
Duncan

(10) Patent No.: US 7,848,929 B2
(45) Date of Patent: Dec. 7, 2010

(54) METHOD AND APPARATUS FOR PACKING AND DECODING AUDIO AND OTHER DATA

(75) Inventor: David Duncan, Pyrford (GB)

(73) Assignee: Harris Systems Limited, Berkshire (GB)

( * ) Notice: Subject to any disclaimer, the term of this patent is extended or adjusted under 35 U.S.C. 154(b) by 1984 days.

(21) Appl. No.: 09/776,730

(22) Filed: Feb. 6, 2001

(65) Prior Publication Data

US 2002/0147594 A1 Oct. 10, 2002

(51) Int. Cl.
*G10L 19/00* (2006.01)
*G10L 19/14* (2006.01)

(52) U.S. Cl. ..... 704/500; 704/E19.041

(58) Field of Classification Search ..... 704/229, 704/212, 500; 705/1; 341/110; 386/95; 375/240, 340; 370/326
See application file for complete search history.

(56) References Cited

U.S. PATENT DOCUMENTS 5,241,382 A * 8/1993 Paik et al. ..... 375/240.25
5,794,181 A * 8/1998 Benbassat et al. ..... 704/212
5,825,830 A * 10/1998 Kopf ..... 375/340
5,963,909 A * 10/1999 Warren et al. ..... 705/1
6,201,798 B1 * 3/2001 Campanella et al. ..... 370/326
6,243,032 B1 * 6/2001 Uramoto et al. ..... 341/110
6,446,037 B1 * 9/2002 Fielder et al. ..... 704/229
6,560,403 B1 * 5/2003 Tanaka et al. ..... 386/95

* cited by examiner

*Primary Examiner*—Angela A Armstrong
(74) *Attorney, Agent, or Firm*—Duane Morris, LLP

(57) ABSTRACT

A method and apparatus for compressing digital data, particularly audio and other data, in a way that the packing method used can be automatically detected and decoded at the receiving station. The audio signal is divided into compression packets consisting of four word pairs of left and right words. The first word pair in each compression packet is tagged with an identifier to indicate the start of a new compression packet, and is provided with configuration information which, over an entire compression block of 48 compression packets, constructs a 48-bit word specifying the manner in which the compressed audio and other data is packed. The method and apparatus of the invention is able to compress digital audio and other data to accommodate 16-, 20-and 24-bit resolutions and transmit up to eight channels of audio information in a variety of formats, and makes more efficient use of available bandwidth in the 16-, 20-or 24-bit output by allowing other information to be embedded into the least significant bits of the remaining available compression packet space which would otherwise be dropped.

20 Claims, 5 Drawing Sheets

| Transport Length | Audio Resolution | Audio Channels | M | T | S | Packing Code | Comment |
|---|---|---|---|---|---|---|---|
| 16-bit | 16-bit | 7.1 | | X | | 1 | |
| 16-bit | 16-bit | 7.1 | | | X | 2 | |
| 16-bit | 16-bit | 6 | X | X | X | 3 | |
| 16-bit | 20-bit | 6 | | | | 4 | |
| 16-bit | 20-bit | 5.1 | X | X | | 5 | |
| 16-bit | 20-bit | 5.1 | X | | X | 6 | |
| 16-bit | 20-bit | 5.1 | | X | X | 7 | |
| 16-bit | 24-bit | 4 | X | X | X | 8 | |
| 20-bit | 16-bit | 8 | X | X | X | 9 | |
| 20-bit | 20-bit | 7.1 | | X | | 10 | |
| 20-bit | 20-bit | 7.1 | | | X | 11 | |
| 20-bit | 20-bit | 6 | X | X | X | 12 | |
| 20-bit | 24-bit | 6 | X | | | 13 | |
| 20-bit | 24-bit | 6 | | X | X | 14 | |
| 20-bit | 24-bit | 5.1 | X | X | X | 15 | |
| 20-bit | 20 & 16-bit | 6 + 2 | | | | 16 | 6 at 20-bit, 2 at 16-bit |
| 20-bit | 20 & 16-bit | 5.1 + 2 | X | X | | 17 | 5.1 at 20-bit, 2 at 16-bit |
| 20-bit | 20 & 16-bit | 5.1 + 2 | X | | X | 18 | 5.1 at 20-bit, 2 at 16-bit |
| 24-bit | 20-bit | 8 | X | X | X | 19 | |
| 24-bit | 24-bit | 7.1 | X | | | 20 | |
| 24-bit | 24-bit | 7.1 | | X | X | 21 | |
| 24-bit | 24-bit | 6 | X | X | X | 22 | |
| 24-bit | 24 & 20-bit | 6 + 2 | | | | 23 | 6 at 24-bit, 2 at 20-bit |
| 24-bit | 24 & 20-bit | 5.1 + 2 | X | X | X | 24 | 5.1 at 20-bit, 2 at 20-bit |
| 16-bit | 20-bit | 5.1 | X | | | 25 | Special Non $8000_H$ |
| 20-bit | 16-bit | 8 | | | X | 26 | Euro Hits Packing |
| 20-bit | 16-bit | 8 | | | | 0 | Old Packing Scheme |

| | MSB | | | | | | | LSB | |
|---|---|---|---|---|---|---|---|---|---|
| | 7 | 6 | 5 | 4 | 3 | 2 | 1 | 0 | |
| Byte 0 | 1 | 1 | 1 | 1 | 1 | 1 | 1 | 1 | Sync 1 |
| Byte 1 | 1 | 0 | 0 | 0 | 0 | 1 | 1 | 1 | Sync 2 |
| Byte 2 | c | | | | b | | a | | Transport ID |
| Byte 3 | 0 | r | | | | f | e | d | Data ID |
| Byte 4 | 0 | r | | | | | | | Reserved |
| Byte 5 | 0 | r | | | | | | | Reserved |

| Transport Length | Audio Resolution | Audio Channels | M | T | S | Packing Code | Comment |
|---|---|---|---|---|---|---|---|
| | | | | | | | |
| 16-bit | 16-bit | 7.1 | | X | | 1 | |
| 16-bit | 16-bit | 7.1 | | | X | 2 | |
| 16-bit | 16-bit | 6 | X | X | X | 3 | |
| | | | | | | | |
| 16-bit | 20-bit | 6 | | | | 4 | |
| 16-bit | 20-bit | 5.1 | X | X | | 5 | |
| 16-bit | 20-bit | 5.1 | X | | X | 6 | |
| 16-bit | 20-bit | 5.1 | | X | X | 7 | |
| | | | | | | | |
| 16-bit | 24-bit | 4 | X | X | X | 8 | |
| | | | | | | | |
| 20-bit | 16-bit | 8 | X | X | X | 9 | |
| | | | | | | | |
| 20-bit | 20-bit | 7.1 | | X | | 10 | |
| 20-bit | 20-bit | 7.1 | | | X | 11 | |
| 20-bit | 20-bit | 6 | X | X | X | 12 | |
| | | | | | | | |
| 20-bit | 24-bit | 6 | X | | | 13 | |
| 20-bit | 24-bit | 6 | | X | X | 14 | |
| 20-bit | 24-bit | 5.1 | X | X | X | 15 | |
| | | | | | | | |
| 20-bit | 20 & 16-bit | 6 + 2 | | | | 16 | 6 at 20-bit, 2 at 16-bit |
| 20-bit | 20 & 16-bit | 5.1 + 2 | X | X | | 17 | 5.1 at 20-bit, 2 at 16-bit |
| 20-bit | 20 & 16-bit | 5.1 + 2 | X | | X | 18 | 5.1 at 20-bit, 2 at 16-bit |
| | | | | | | | |
| 24-bit | 20-bit | 8 | X | X | X | 19 | |
| | | | | | | | |
| 24-bit | 24-bit | 7.1 | X | | | 20 | |
| 24-bit | 24-bit | 7.1 | | X | X | 21 | |
| 24-bit | 24-bit | 6 | X | X | X | 22 | |
| | | | | | | | |
| 24-bit | 24 & 20-bit | 6 + 2 | | | | 23 | 6 at 24-bit, 2 at 20-bit |
| 24-bit | 24 & 20-bit | 5.1 + 2 | X | X | X | 24 | 5.1 at 20-bit, 2 at 20-bit |
| | | | | | | | |
| 16-bit | 20-bit | 5.1 | X | | | 25 | Special Non $8000_H$ |
| 20-bit | 16-bit | 8 | | | X | 26 | Euro Hits Packing |
| 20-bit | 16-bit | 8 | | | | 0 | Old Packing Scheme |
| | | | | | | | |

Fig. 7

METHOD AND APPARATUS FOR PACKING AND DECODING AUDIO AND OTHER DATA

FIELD OF INVENTION

This invention relates to audio compression. In particular, this invention relates to a method and apparatus for compressing and decoding audio and other data in a standard format.

BACKGROUND OF THE INVENTION

The Audio Engineering Society (AES) has developed a standard for the serial transmission of two channels of audio data over shielded twisted-pair conductors, as embodied in AES Standard AES3-1992 titled "AES Recommended Practice for Digital Audio Engineering—Serial Transmission Format for Two-Channel Linearly Represented Digital Audio Data", which is incorporated herein by reference.

The AES standard for two-channel serial transmission is designed to accommodate a signal having audio sub-frames of a fixed transport length. The standard accommodates either 24-bit audio sub-frames, or 20-bit audio sub-frames with an additional four-bit auxiliary data field. This results in an inefficient use of bandwidth when used with signals having different resolutions. Moreover, the audio compression standard is adapted to transmit only a limited amount of data relating to the audio stream. There is a need for a system which can accommodate different transport lengths within a single audio stream, and which allows for the ability to embed other data.

Data compression is commonly used in the transmission of digital audio signals in broadcasting and network communications. The compression of audio data increases the rate at which data can be transmitted in a serial format. A compression technique, called apt-X, has been developed which can be employed to compress audio signals in 16-bit, 20-bit, or 24-bit resolution AES format by a factor of 4 to 1. The apt-X compressed audio can then be formatted to be carried on AES equipment. However, previous implementations of apt-X compression required the number and resolution of the signals input to the compression system to be determined in advance, and did not allow the number and resolution of the signals carried to be easily changed, nor did it allow the transportation of additional data.

SUMMARY OF THE INVENTION

The present invention provides a method and apparatus for compressing digital data which is particularly adapted for the compression of audio streams containing audio and other data. The method and apparatus of the invention provides a means for packing compressed audio and other data within the available bits for an audio sub-frame under the current AES standard (ANSI S4.40-1992) in a way that the packing method used can be automatically detected and decoded at the receiving station.

According to the invention, the audio signal is divided into "compression packets" consisting of four word pairs of left and right words. The first word pair in each compression packet is tagged with a unique identifier, and is provided with configuration information which allows the audio and other data to be decoded at the receiving station. In the preferred embodiment the first significant bit of the first left word (x or z sub-frame) is tagged, and the second most significant bit of the first left word is provided with configuration information which, over an entire "compression block" of 48 compression packets, constructs a 48-bit word consisting of six bytes of data specifying the manner in which the compressed audio and other data is packed.

The method and apparatus of the invention accordingly provides a universal standard which is able to compress digital audio and other data to accommodate 16-, 20- and 24-bit resolutions and transmit up to eight channels of audio information in a variety of formats, including formats in which different channels have sub-frames with different resolutions.

The present invention thus provides a method of compressing digital audio data and other data into an audio signal for transmission to a receiving station, comprising the steps of: a. dividing the audio signal into compression blocks, each compression block consisting of a plurality of compression packets, each compression packet consisting of a plurality of words, b. providing one word in each compression packet with a component of configuration data, whereby a compression block contains sufficient configuration information to identify a manner of packing data into the compression block, c. tagging one word in each compression packet to identify the tagged word as a word containing configuration information, d. packing compressed audio and other data into remaining space within the compression packet, and e. transmitting the compression packets in a predetermined sequence to a receiving station, wherein the receiving station constructs the configuration information from the tagged words in a compression block and decodes the compressed audio data and other data according to the configuration information.

The present invention further provides an apparatus for adding digital audio data and other data into an audio signal for transmission to a receiving station, comprising an encoder for dividing the audio signal into compression blocks, each compression block consisting of a plurality of compression packets, each compression packet consisting of a plurality of words, providing one word in each compression packet with a component of configuration data, whereby a compression block contains sufficient configuration information to identify a manner of packing data into the compression block, tagging one word in each compression packet to identify the tagged word as a word containing configuration information, and packing compressed audio and other data into remaining space within the compression packet; a transmitter for transmitting the compression packets in a predetermined sequence to a receiving station; and a decoder at the receiving station for constructing the configuration information from the tagged words in a compression block and decoding the compressed audio data and other data from the configuration information.

In further aspects of the method and apparatus of the invention: each compression packet consists of four word pairs; a first most significant bit of a first word pair is tagged; a second most significant bit of the first word pair holds the component of configuration data; each compression block consists of 48 compression packets; the compression information comprises synchronization information, transport identification information, and data identification information; one or more bytes are dedicated to the synchronization information, one byte is dedicated to transport identification information and one byte is dedicated to data identification information; each word has 24, 20 or 16 bits; the audio data comprises a plurality of channels and is packed into the remaining space in the compression packet leaving no empty bits between channel data; and/or the audio data and other data comprises metadata, linear time code data and channel status data.

BRIEF DESCRIPTION OF THE DRAWINGS

In drawings which illustrate by way of example only a preferred embodiment of the invention, FIG. 7 is a chart illustrating examples of variations in compressed packing which may be implemented according to the invention.

DETAILED DESCRIPTION OF THE INVENTION

Figure 1:
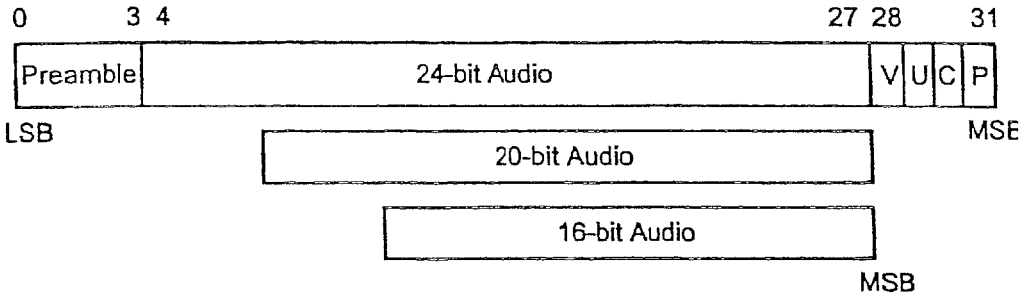
Prior Art Fig. 1
FIG. 1 is a schematic representation of a 32 bit AES audio sub-frame according to the AES standard ANSI S4.40-1992.

FIG. 1 illustrates a typical 32 bit audio sub-frame according to AES standard ANSI S4.40-1992, which is incorporated herein by reference, showing the least significant bits (LSB) on the left and the most significant bits (MSB) on the right. The MSB comprise bits representing the parity (P), channel status (C), user (U) and validity (V) in bits 0 to 3, respectively. Audio data is packed into bits 4 to 27, which will thus accommodate up to 24-bit resolution. The sub-frame is transmitted LSB first, so that the preamble is the leading information in the sub-frame. In systems which are capable of transmitting only 20-bit or 16-bit sub-frames, the least significant bits of the audio segment of the sub-frame are dropped.

Figure 2:
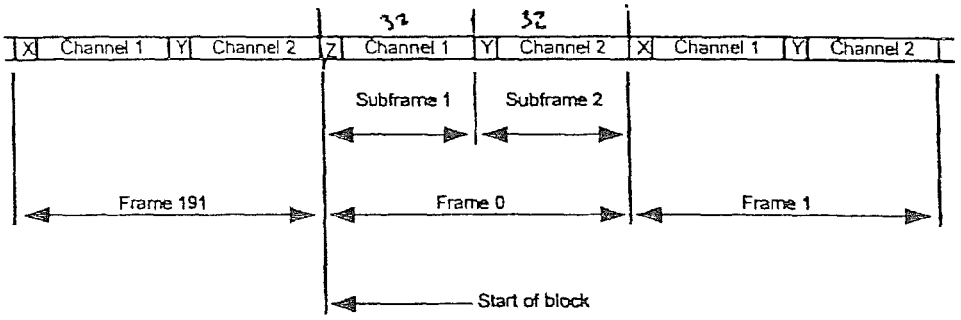
Prior Art Fig. 2
FIG. 2 is a schematic representation of a transition between blocks of compressed two-channel audio data.

An audio frame is composed of two such sub-frames. According to AES3-1992, each block of compressed two-channel audio comprises 192 audio frames. FIG. 2 illustrates the transition between blocks in a compressed two-channel audio signal, the designation z indicating the start of each new block (equivalent to an x sub-frame, but designated z to signify the first sub-frame of a new block).

With a compression rate of 4:1, under the standard AES transport system there is a reduced word rate for the compression data of 12 kHz from an original sample rate of 48 kHz. According to the invention this allows for the transport of a "compression packet" consisting of four word pairs, each word pair being transported at 48 kHz so the complete sequence of four word pairs is repeated at a rate of 12 kHz. The first word pair in each compression packet is tagged with a unique identifier, and is provided with a component of configuration information which allows the manner in which the data is packed into the compression packet to be determined so the data can be decoded at the receiving station.

Figures 3, 4:
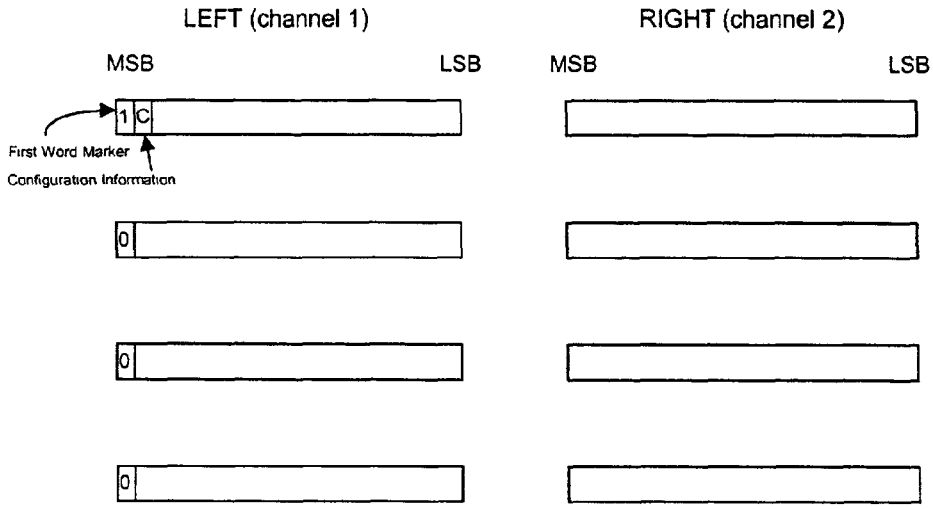
FIG. 3 is a schematic representation of a compression packet according to the invention.
FIG. 4 illustrates the preferred byte assignments for the six bytes of configuration information in a compression block.

FIG. 3 illustrates a compression packet according to the invention, having word pairs each respectively consisting of left and right words. The length of the words is determined by the selected transport length and may be either 24, 20 or 16 bits. In the preferred embodiment of the invention, the first most significant bit of the first left word (x or z sub-frame) in the compression packet is tagged with a marker, for example "1" in the embodiment shown in FIG. 3, to identify it as an x (or z) sub-frame containing configuration information. The first bit in each remaining left word in the compression packet is set to "0".

The second most significant bit of the first left word (x or z sub-frame) in the first word pair of a compression packet is provided with a component of configuration information such that, over an entire "compression block" consisting of 192 audio frames (48 compression packets), the configuration information components construct configuration information, in the preferred embodiment a 48 bit word consisting of six bytes of information, specifying the manner in which compressed audio and other data are packed within the compression block.

FIG. 4 illustrates the preferred byte assignments for the six bytes of configuration information in a compression block, as follows:

Byte 0

First Synchronization Word

Byte 1

Second Synchronization Word

| Byte 2 | |
|---|---|
| "a" Transport length | 00 = 16-bit |
| | 01 = 18-bit |
| | 10 = 20-bit |
| | 11 = 24-bit |
| "b" Audio resolution | 00 = 16-bit |
| | 01 = 18-bit |
| | 10 = 20-bit |
| | 11 = 24-bit |
| "c" Number of audio channels | 0001 = 5.1 + 2 |
| | 0010 = 6+ 2 |
| | 0100 = 4 |
| | 1110 = 6 |
| | 1000 = 8 |
| | 1101 = 5.1 |
| | 1110 = 7.1 |
| | 1111 = Illegal State |
| | Other values = Not Defined |
| **Byte 3** | |
| "d" Channel Status | 1 = Channel Status embedded |
| (4 bits required) | 0 = No Channel Status |
| "e" LTC | 1 = Linear Time Code embedded |
| (4 bits required) | 0 = No LTC |
| "f" Metadata | 1 = Metadata embedded |
| (10 bits required) | 0 = No Metadata |
| "r" reserved for future use | 0 = Default state |

Some audio equipment does not support the transmission of AES status (bit 30 in the AES subframe), so the compression packets do not need to be synchronized with the beginning of the 192 frame AES standard block. Additionally, some 16-bit transmission equipment does not provide a transparent path for 16-bit data, which usually manifests in the value $8000_H$ being rounded up to $8001_H$. This will not effect audio data because $8000_H$ is an invalid value for audio data, but in other data the value of $8000_H$ will occur. To avoid problems due to rounding up, a special configuration data setup of all "1" (including synchronization bits) may be reserved for 16-bit transport; 20-bit resolution; 5.1 audio channels; and metadata; to which special decoding rules will apply.

The audio and other data is packed into the compression packet in a predetermined order, which is recognized at the receiving station for decoding. In the preferred embodiment the compressed audio and selected other data are packed into the remaining available space in the compression packet in the following order:

Compressed audio channels

Metadata
Linear time code (LTC)
Channel Status
Additional data (as required)

Figure 5:
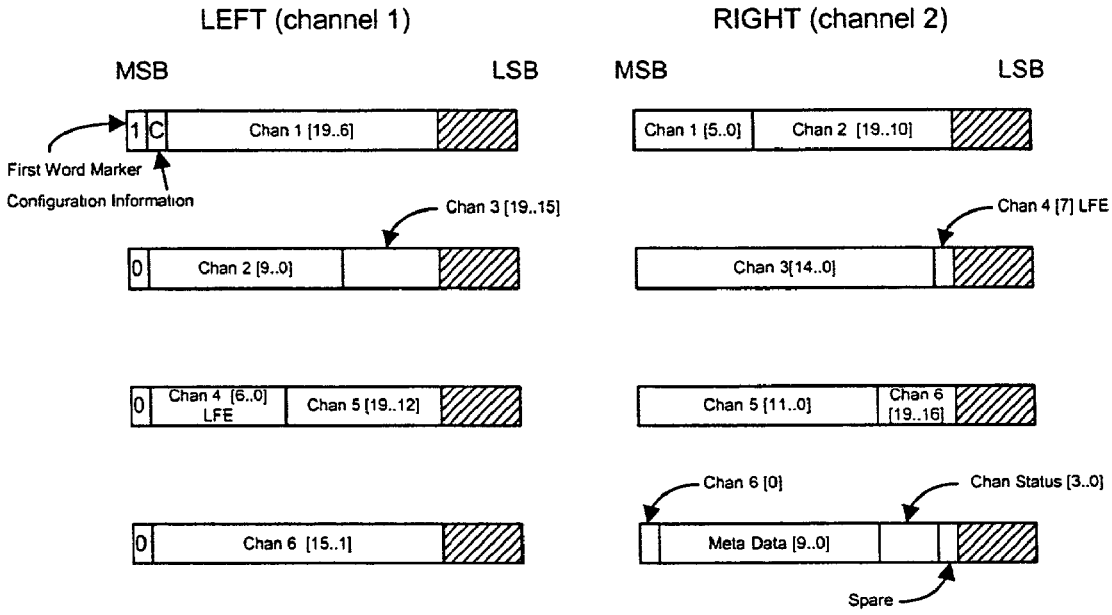
FIG. 5 is a schematic representation of an example of a compression packet according to the invention for packing 20-bit resolution audio into a 16-bit transport.

The compressed audio is packed into the MSB of the next available space (the left word having priority over the right), and all data following the MSB of the first left data word is left-justified into the remaining space. Where an LFE channel is used (for example in 5.1 and 7.1 formats), the LFE channel is packed as the fourth audio channel. Where the number of channels is 6+2 or 5.1+2, the first number indicates the number of channels selected at the chosen (higher) resolution followed by two channels at the next lower resolution, and the channels are packed in that order. FIG. 5 illustrates as an example a compression packet in which 20-bit resolution audio is packed into a 16-bit transport along with metadata and channel status information.

Metadata is packed into a 10-bit word having one start bit, eight bits of data, even parity and one stop bit. It is expected that metadata will occur at a rate of less than 12 kHz, so not every compression packet will contain metadata data. However, every compression packet has a metadata word, so the MSB (bit 9) of the 10-bit word is used to indicate that valid data is present. Bit 8 holds the parity and bits 7 to 0 hold the 8-bit data word.

The linear time code (LTC) is usually represented as a linear audio channel, and may be sampled at a rate of 48 kHz with a one-bit resolution. Thus, with the four frame compression packet four bits are required to represent the four samples. When the data is converted back into linear audio, care must be taken to round the edges.

The channel status does not need to be updated on every frame, so a slow response can be tolerated. Also, not every bit of channel status needs to be replicated. The channel status is carried in a 48-word sequence (one word per compression packet) of 4-bit words. The first 4-bit word is a header indicating which of the possible 8 channels of status is present, and the remaining 47 words carry up to 188 bits of status. This sequence, repeated for each channel in sequence, gives a transfer rate of 32 ms.

Figure 6:
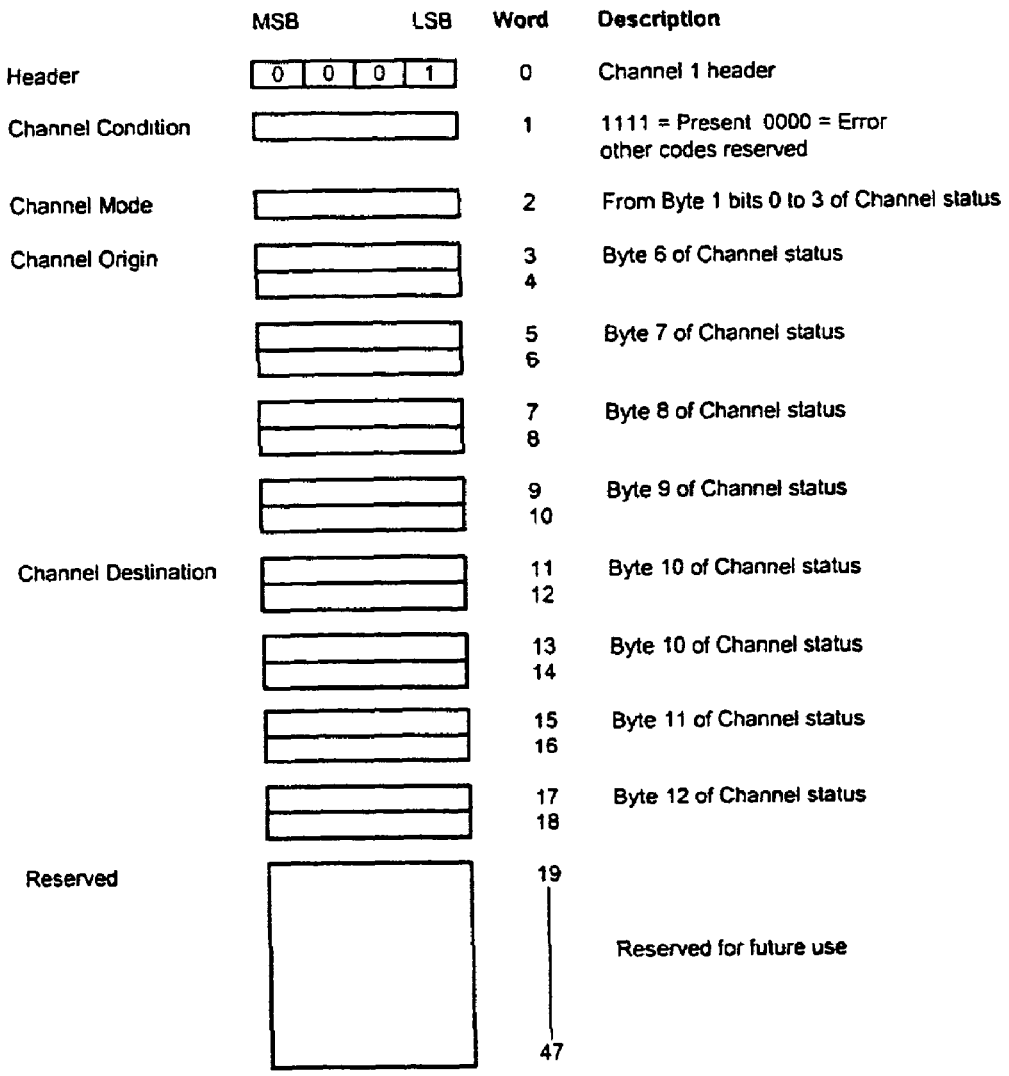
FIG. 6 is a schematic representation of a channel status frame.

The channel status header is present in the first compression packet in each compression block, and thus coincides with the first bit of the configuration data. The channel status cycles through each channel in turn. The channel status header has values 1 to 8, indicating the channel number to which the status information which follows is associated. At present only "channel mode", "channel origin" and "channel destination" need to be stored for each channel; the remaining data is essentially meaningless in association with compressed audio data, but this space is reserved for possible future use in case more status information is required in the future. FIG. 6 illustrates an example of a channel status frame according to the invention.

FIG. 7 illustrates (non-limiting) examples of variations in compressed packing which may be implemented according to the invention, in which M represents metadata, T represents the time code and S represents the channel status.

A preferred embodiment of the invention having been thus described by way of example only, it will be apparent to those skilled in the art that certain modifications and adaptations may be made without departing from the scope of the invention, as set out in the appended claims.

I claim:

1. A method of compressing digital audio data and other data into an audio signal for transmission to a receiving station, comprising the steps of:

a. dividing the audio signal into compression blocks, each compression block consisting of a plurality of compression packets, each compression packet consisting of a plurality of words, b. providing one word in each compression packet with a component of configuration data, whereby a compression block contains configuration information identifying a manner of packing data into the compression block, c. tagging one word in each compression packet to identify the tagged word as a word containing configuration information, d. packing compressed audio and other data into remaining space within the compression packet, and e. transmitting the compression packets in a predetermined sequence to a receiving station, wherein the receiving station constructs the configuration information from the tagged words in a compression block and decodes the compressed audio data and other data according to the configuration information.

2. The method of claim 1 in which each compression packet consists of four word pairs.

3. The method of claim 2 in which a first most significant bit of a first word pair is tagged.

4. The method of claim 3 in which a second most significant bit of the first word pair holds the component of configuration data.

5. The method of claim 2 in which each compression block consists of 48 compression packets.

6. The method of claim 5 in which the compression information comprises synchronization information, transport identification information, and data identification information.

7. The method of claim 6 in which one or more bytes are dedicated to the synchronization information, one byte is dedicated to transport identification information and one byte is dedicated to data identification information.

8. The method of claim 2 in which each word has 24, 20 or 16 bits.

9. The method of claim 1 in which the audio data comprises a plurality of channels and is packed into the remaining space in the compression packet leaving no empty bits between channel data.

10. The method of claim 1 in which the audio data and other data comprises metadata, linear time code data and channel status data.

11. An apparatus for adding digital audio data and other data into an audio signal for transmission to a receiving station, comprising:

an encoder for dividing the audio signal into compression blocks, each compression block consisting of a plurality of compression packets, each compression packet consisting of a plurality of words, providing one word in each compression packet with a component of configuration data, whereby a compression block contains configuration information identifying a manner of packing data into the compression block, tagging one word in each compression packet to identify the tagged word as a word containing configuration information, and packing compressed audio and other data into remaining space within the compression packet, a transmitter for transmitting the compression packets in a predetermined sequence to a receiving station, and a decoder at the receiving station for constructing the configuration information from the tagged words in a compression block and decoding the compressed audio data and other data according to the configuration information.

12. The apparatus of claim 11 in which each compression packet consists of four word pairs.

13. The apparatus of claim 12 in which a first most significant bit of a first word pair is tagged.

14. The apparatus of claim 13 in which a second most significant bit of the first word pair holds the component of configuration data.

15. The apparatus of claim 12 in which each compression block consists of 48 compression packets.

16. The apparatus of claim 15 in which the compression information comprises synchronization information, transport identification information, and data identification information.

17. The apparatus of claim 16 in which one or more bytes are dedicated to the synchronization information, one byte is dedicated to transport identification information and one byte is dedicated to data identification information.

18. The apparatus of claim 12 in which each word has 24, 20 or 16 bits.

19. The apparatus of claim 11 in which the audio data comprises a plurality of channels and is packed into the remaining space in the compression packet leaving no empty bits between channel data.

20. The apparatus of claim 11 in which the audio data and other data comprises metadata, linear time code data and channel status data.

* * * * *